US005384888A

United States Patent [19]

Peng

[11] Patent Number: 5,384,888

[45] Date of Patent: Jan. 24, 1995

[54] VAPORIZER WITH ELECTRODE POSITIONING

[75] Inventor: Johnson Peng, Taipei, Taiwan, Prov. of China

[73] Assignee: Duracraft Corporation, Whitinsville, Mass.

[21] Appl. No.: 165,206

[22] Filed: Dec. 13, 1993

[51] Int. Cl.[6] ..... F22B 1/30; H05B 3/60

[52] U.S. Cl. ..... 392/336; 392/333

[58] Field of Search ..... 392/311–338; 338/80–83, 86; 422/120, 298, 22; 128/203.17

[56] References Cited

U.S. PATENT DOCUMENTS

| | | | |
|---|---|---|---|
| 374,404 | 12/1887 | Field | 338/82 |
| 472,062 | 4/1892 | Masury | 338/81 |
| 475,255 | 5/1892 | Sterling | 338/83 |
| 1,981,765 | 11/1934 | Weiss | 392/335 |
| 2,312,677 | 3/1943 | Shrum | 392/338 |
| 2,775,372 | 12/1956 | Jordan | 222/182 |
| 2,843,891 | 7/1958 | Fisher | 392/337 |

*Primary Examiner*—Bruce A. Reynolds
*Assistant Examiner*—John A. Jeffery
*Attorney, Agent, or Firm*—John E. Toupal; Harold G. Jarcho

[57] ABSTRACT

A vaporizer having first and second substantially parallel electrodes with upper ends connected to a voltage source and free lower ends projecting into a boiler chamber; a compartment defining the boiler chamber and enclosing the electrodes; and a locator mechanism disposed in the compartment and arranged to engage and position lower ends of the first and second electrodes, the locator mechanism including a plurality of guide surfaces inclined with respect to the first and second electrodes and arranged to engage and guide movement of the lower ends thereof into the compartment.

17 Claims, 2 Drawing Sheets

VAPORIZER WITH ELECTRODE POSITIONING

BACKGROUND OF THE INVENTION

This invention relates generally to a vaporizer and, more particularly, to an electrical vaporizer having a pair of parallel electrodes projecting into a boiler chamber.

Electrode type vaporizers typically have a pair of opposite polarity electrodes projecting into a boiler chamber. The liquid conducts current between the electrodes producing resistance heating that induces boiling of the liquid and resultant vapor. Generally, the vaporizer includes a compartment to isolate the boiler chamber from a larger reservoir and the electrodes from a user. During operation of the vaporizer, the spacing between the electrodes controls the magnitude of current flow which should be uniform to provide consistent performance. However, factors such as inaccurate electrode assembly or heat induced electrode distortion can cause erratic vaporizer performance.

In attempts to overcome the above problems, some vaporizers have been equipped with members that position free ends of vaporizer electrodes. Devices of that type are disclosed in U.S. Pat. Nos. 1,981,765; 2,755,372 and 2,843,891. Although alleviating erratic performance, prior electrode positioning structures have undesirably complicated vaporizer assembly operations.

The object of this invention, therefore, is to provide an electrode vaporizer with predictable performance characteristics.

SUMMARY OF THE INVENTION

The invention is a vaporizer having first end second substantially parallel electrodes with upper ends connected to a voltage source and free lower ends projecting into a boiler chamber; a compartment defining the boiler chamber and enclosing the electrodes; and a locator mechanism disposed in the compartment and arranged to engage and position lower ends of the first and second electrodes, the locator mechanism including a plurality of guide surfaces inclined with respect to the first and second electrodes and arranged to engage and guide movement of the lower ends thereof into the compartment. The locator mechanism enhances uniform vaporizer performance and the inclined guide surfaces simplify assembly.

According to one feature of the invention, the guide surfaces include a first pair of guide surfaces defining a first cavity for receiving the lower end of the first electrode, and a second pair of guide surfaces defining a second cavity for receiving the lower end of the second electrode. The first and second cavities accurately position, respectively, the lower ends of the first and second electrodes.

According to another feature of the invention, each of the first and second pairs of guide surfaces are downwardly converging so as to provide each of the first and second cavities with an upwardly directed mouth having a given width for receiving one of the lower ends and a lower seat portion having a width less than the given width so as to accurately position the lower end. The wider mouths of the cavities facilitate entry of the electrodes thereinto.

According to other features of the invention, the guide surfaces are formed by inclined edges of plate members projecting upwardly from a bottom end of the compartment. The formation of guide surfaces with plate members reduces material costs for the vaporizer.

According to still another feature of the invention, each of the first and second electrodes has an elongated cross section disposed transversely to the plate members. Insertion of the electrodes into the cavities is facilitated by the transverse channel and plate geometry.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
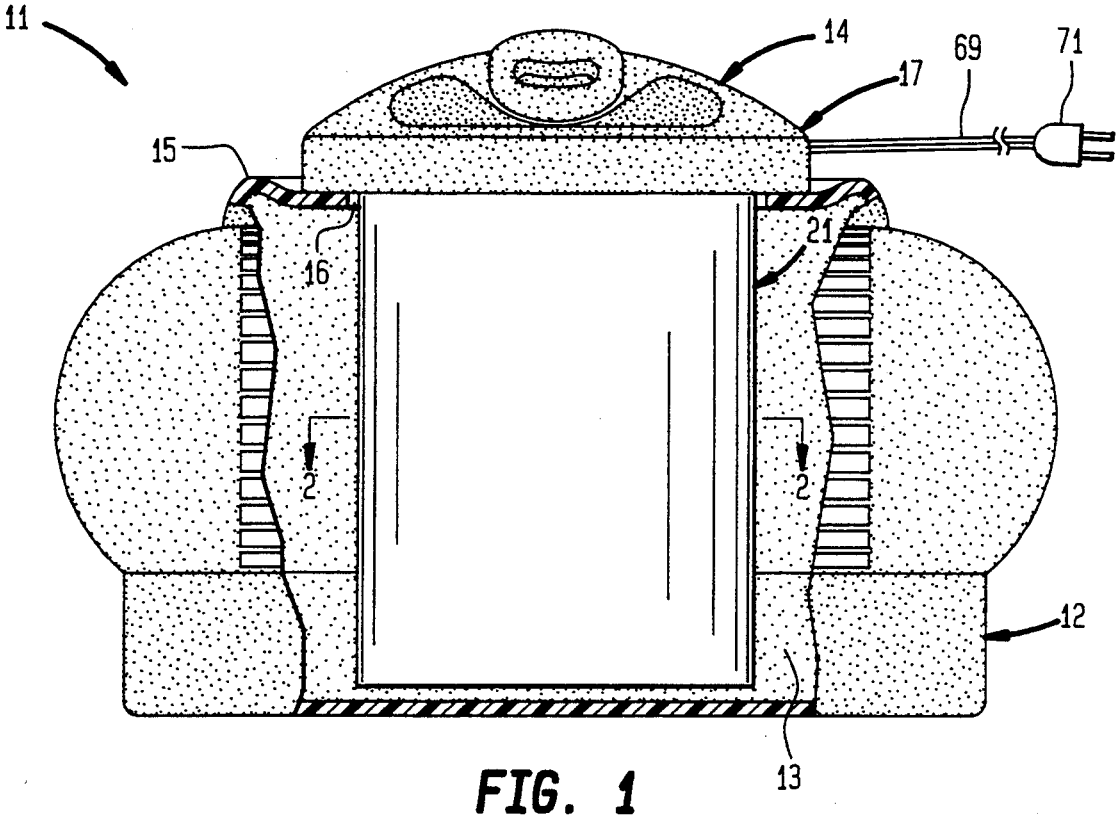
FIG. 1 is a partially broken away plan view of a vaporizer according to the invention.

A vaporizer 11 includes a hollow molded base 12 defining a liquid reservoir 13 and a vaporizer unit 14 supported by the base 12. An upper wall 15 of the base 12 defines an upper opening 16 providing access to the reservoir 13 and permitting filling thereof with a suitable liquid. A head portion 17 of the vaporizer unit 14 is supported by the upper wall 15 of the base 12 and covers the opening 16 therein. Also forming a part of the vaporizer unit 14 is a tubular structure 21 that projects downwardly into the reservoir 13 and is shown in greater detail in FIGS. 2 and 3.

The tubular structure 21 includes an outer, open bottom tubular member 22 and a concentric inner tubular member 23 longitudinally separated by a divider wall 25 into a heating compartment 26 and a liquid recovery chamber 27. An upper flange portion 29 of the tubular structure 21 is secured to tabs on the head 17 by the screws 31.

Figure 2:
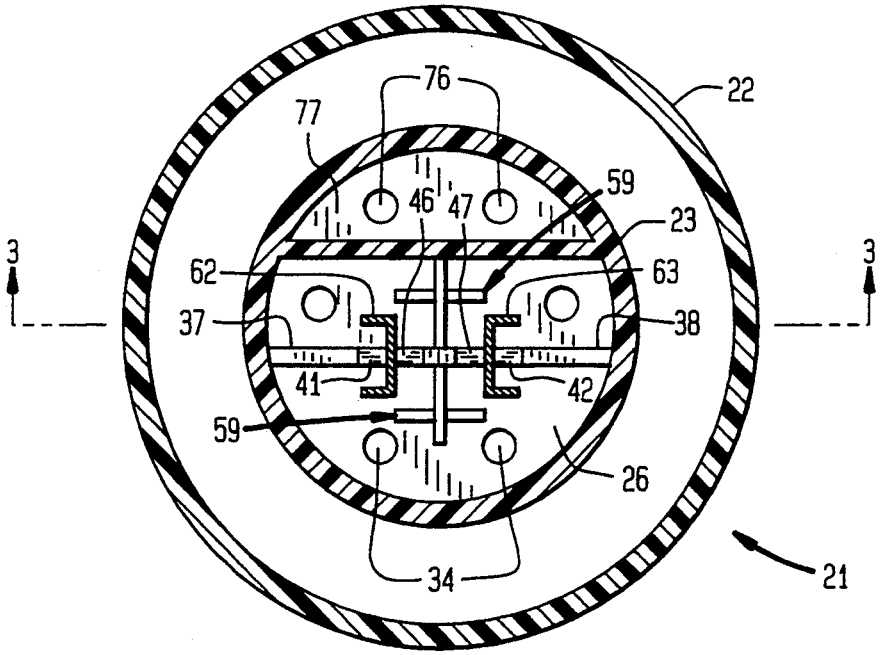
FIG. 2 is a cross sectional view taken along lines 2—2 of FIG. 1.
Figure 3:
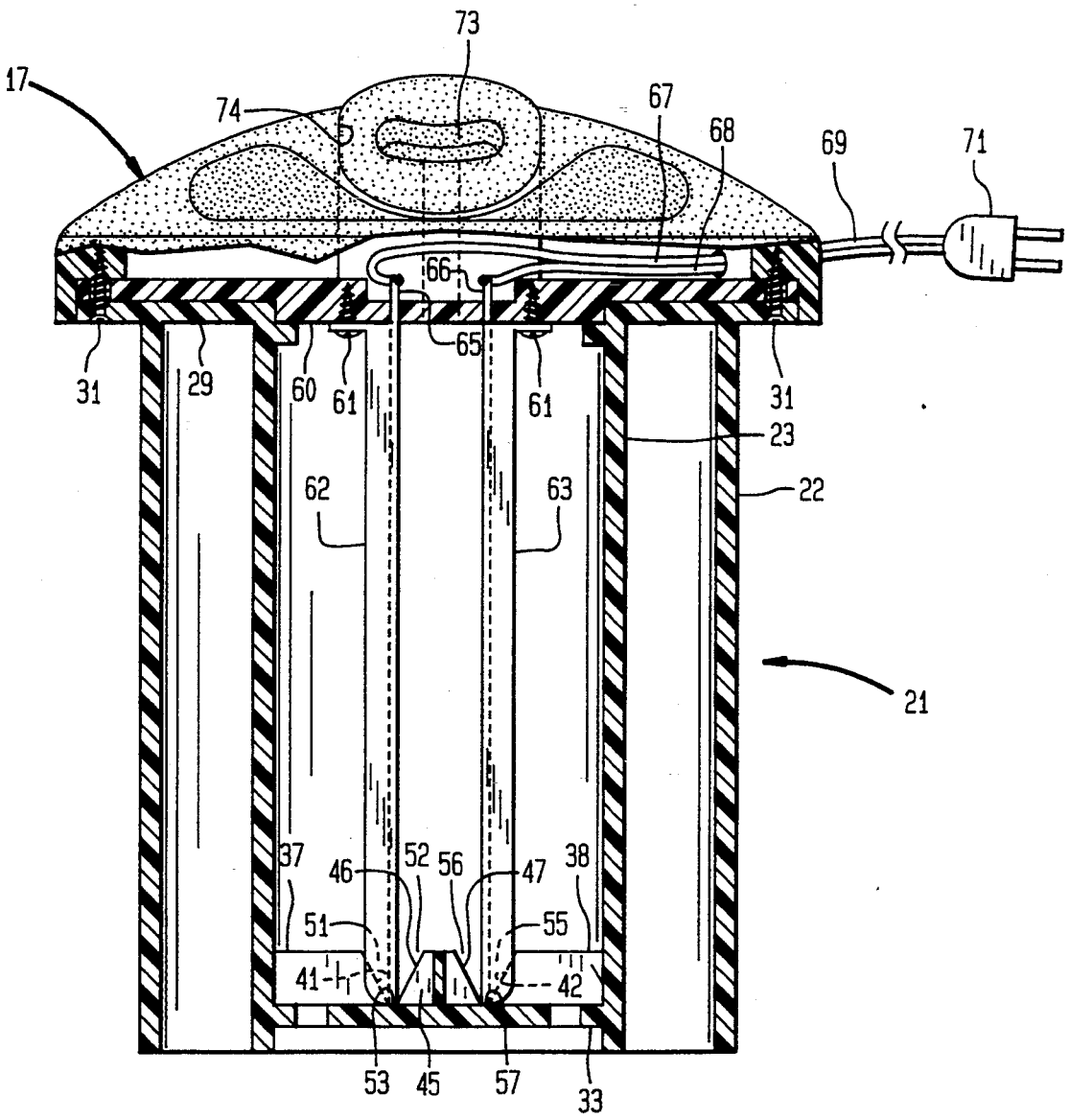
FIG. 3 is a cross sectional view taken along lines 3—3 of FIG. 2.

As shown in FIGS. 2 and 3, the bottom end of the heating compartment 26 is closed by a wall 33 that defines a plurality of apertures 34 communicating with the reservoir 13. Projecting upwardly from the bottom wall 33 and inwardly from the inner tubular member 23 are radially directed locator plate members 37, 38. Inclined inner edges of the plate members 37, 38 form, respectively, guide surfaces 41, 42. Also projecting upwardly from the bottom wall 33 and aligned with the plate members 37, 38 is a third plate member 45 having outer edges that form, respectively, inclined guide surfaces 46, 47.

The downwardly converging guide surfaces 41 and 46 form a first cavity 51 having an upwardly directed mouth 52 of a given width and a lower seat portion 53 of a predetermined width less than the given width. Similarly, the downwardly converging guide surfaces 42, 47 form a second cavity 55 having an upwardly directed mouth 56 of the given width and a lower seat portion 57 of the substantially lessor predetermined width. Projecting from opposite sides of the third plate member 45 is a composite support structure 59. Preferably, the outer tubular member 22, the inner tubular member 23, the flange portion 29, the bottom wall 33 and the plate members 37, 38 and 45 are integrally molded as a unitary structure.

A mounting plate 59 is attached to the flange portion 29 over an opening therein by screws 60. Secured by screws 61 to the mounting plate 59 are upper ends of first and second channel shaped, parallel plate electrodes 62, 63 projecting vertically downwardly into the inner tubular member 23. The upper ends of the first and second electrodes 62, 63 are connected, respectively, to terminals 65, 66 that project through the mounting plate 59. Connected to the terminals 65, 66, respectively, are electrical wires 67, 68 of a cord 69 that terminates with a conventional electrical plug 71. Also supported on the flange portion 29 is a nozzle 73 that communicates with the heating compartment 26 and the recovery chamber 27. The nozzle 73 extends out of a hole 74 in the head 17. Openings 76 in a bottom wall 77 of the recovery chamber 27 provide communication with the reservoir 13.

During assembly of the vaporizer 11, the electrodes 62, 63 are first attached to the mounting plate 59 with the screws 61. The plate 59 then is attached with the screws 60 to the flange portion 29 with the electrodes 62, 63 projecting into the inner tubular member 23. During the insertion process, the lower ends of the electrodes 62, 63 enter, respectively, the first and second cavities 53, 55 allowing the inclined guide surfaces 41, 42, 46 and 47 to guide movement of the electrodes into the fixed positions provided by the seat portions 53, 57. Consequently, the electrodes 62 and 63 will be retained in positions providing a predetermined desired spacing therebetween. Because of the inclined guide surfaces provided by the locator plate members 37, 38 and 45 insertion of the electrodes 62, 63 into the first and second cavities 51, 55, respectively, is greatly simplified. In addition, the transverse orientation of the electrodes 62, 63 elongated cross section accommodates formation of the cavities 51, 55 with relatively narrow plate members 37, 38 and 45 thereby reducing material cost.

During use of the vaporizer 11, the plug 71 is inserted into a conventional electrical outlet producing a voltage gradient between the electrodes 62, 63. Liquid within the heating compartment 26 conducts electrical current between the electrodes 62, 63 and produces heating of the retained liquid. Resulting vapor is transmitted through the heating compartment 26 and the nozzle 73 into the environment surrounding the vaporizer 11. Liquid condensing on the inner surface of the nozzle 73 flows back into the reservoir 13 via the recovery chamber 27. When additional liquid is required within the reservoir 13, the vaporizer unit 14 is withdrawn from the base 12 and filling is permitted through the opening 16 in the upper wall 15.

Obviously, many modifications and variations of the present invention are possible in light of the above teachings. It is to be understood, therefore, that the invention can be practiced otherwise than as specifically described.

What is claimed is:

1. A vaporizer of the type having first and second substantially parallel electrodes with upper ends connected to a voltage source and free lower ends projecting into a boiler chamber, the improvement comprising:

a compartment means defining said boiler chamber and enclosing said electrodes; and locator means disposed in said compartment means and arranged to engage and position said lower ends of said first and second electrodes, said locator means comprising a plurality of guide surfaces inclined with respect to said first and second electrodes and arranged to engage and guide movement of said lower ends thereof into said compartment means.

2. A vaporizer according to claim 1 wherein said guide surfaces comprise a first pair of guide surfaces defining a first cavity for receiving said lower end of said first electrode, and a second pair of guide surfaces defining a second cavity for receiving said lower end of said second electrode.

3. A vaporizer according to claim 2 wherein each of said first and second pairs of guide surfaces are downwardly converging so as to provide each of said first and second cavities with an upwardly directed mouth having a given width for receiving one of said lower ends and a lower seat portion having a width less than said given width so as to accurately position said lower end.

4. A vaporizer according to claim 1 wherein said compartment means has a closed bottom end, and said locator means is retained by said closed bottom end.

5. A vaporizer according to claim 4 wherein said guide surfaces comprise a first pair of guide surfaces defining a first cavity for receiving said lower end of said first electrode, and a second pair of guide surfaces defining a second cavity for receiving said lower end of said second electrode.

6. A vaporizer according to claim 5 wherein each of said first and second pairs of guide surfaces are downwardly converging so as to provide each of said first and second cavities with an upwardly directed mouth having a given width for receiving one of said lower ends and a lower seat portion having a width less than said given width so as to accurately position said lower end.

7. A vaporizer according to claim 4 wherein said closed bottom end and said locator means are a molded unitary structure.

8. A vaporizer according to claim 7 wherein said guide surfaces comprise a first pair of guide surfaces defining a first cavity for receiving said lower end of said first electrode, and a second pair of guide surfaces defining a second cavity for receiving said lower end of said second electrode.

9. A vaporizer according to claim 8 wherein each of said first and second pairs of guide surfaces are downwardly converging so as to provide each of said first and second cavities with an upwardly directed mouth having a given width for receiving one of said lower ends and a lower seat portion having a width less than said given width so as to accurately position said lower end.

10. A vaporizer according to claim 9 wherein each of said guide surfaces is formed by an inclined edge of a plate member projecting upwardly from said bottom end.

11. A vaporizer according to claim 10 wherein each of said first and second electrodes have an elongated cross-section disposed transversely to said plate members.

12. A vaporizer according to claim 1 wherein each of said guide surfaces is formed by an inclined edge of a plate member, and each of said first and second electrodes have an elongated cross section disposed transversely to said plate members.

13. A vaporizer according to claim 12 wherein said guide surfaces comprise a first pair of guide surfaces defining a first cavity for receiving said lower end of said first electrode, and a second pair of guide surfaces defining a second cavity for receiving said lower end of said second electrode.

14. A vaporizer according to claim 13 wherein each of said first and second pairs of guide surfaces are downwardly converging so as to provide each of said first and second cavities with an upwardly directed mouth having a given width for receiving one of said lower ends and a lower seat portion having a width less than said given width so as to accurately position said lower end.

15. A vaporizer according to claim 12 wherein said compartment means has a closed bottom end, and said locator means is retained by said closed bottom end.

16. A vaporizer according to claim 15 wherein said guide surfaces comprise a first pair of guide surfaces defining a first cavity for receiving said lower end of said first electrode, and a second pair of guide surfaces defining a second cavity for receiving said lower end of said second electrode.

17. A vaporizer according to claim 16 wherein each of said first and second pairs of guide surfaces are downwardly converging so as to provide each of said first and second cavities with an upwardly directed mouth having a given width for receiving one of said lower ends and a lower seat portion having a width less than said given width so as to accurately position said lower end.

* * * * *